US006244570B1

(12) United States Patent
Habberstad

(10) Patent No.: US 6,244,570 B1
(45) **Date of Patent: *Jun. 12, 2001**

(54) HIGH SPEED SAFETY BLOCK ASSEMBLY

(76) Inventor: Jeff Habberstad, 26354 Sand Canyon Rd., Canyon Country, CA (US) 91351

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/166,835

(22) Filed: Oct. 5, 1998

(51) Int. Cl.[7] ..... B66D 3/06; B66D 3/26

(52) U.S. Cl. ..... 254/406; 254/399; 254/402; 254/416

(58) Field of Search ..... 254/402, 404, 254/406, 416, 399

(56) References Cited

U.S. PATENT DOCUMENTS

| | | | | |
|---|---|---|---|---|
| 811,191 | * | 1/1906 | Whiteside | 254/406 |
| 973,177 | * | 10/1910 | Davis et al. | 254/406 |
| 1,662,320 | * | 3/1928 | McKissick | 254/406 |
| 2,762,607 | * | 9/1956 | Anderson | 254/406 |
| 5,056,760 | * | 10/1991 | Jorgensen | 254/406 |
| 5,154,401 | * | 10/1992 | Schramm et al. | 254/416 |
| 5,538,224 | * | 7/1996 | Powell et al. | 254/406 |

OTHER PUBLICATIONS

Harken Catalog Cover Page and p. 70—"Airblocks"; and p. 71—"Snatch Blocks"; Publication Date: 1993.

Cmi Moving & Handling Catalog Pages relating to "Service Line" Pulleys, 2 pages; Publication Date: 1996.

Wichard Catalog Page and page relating to "Stainless Steel Blocks"; no date available.

PMI–Petzel Catalog Cover Page and page relating to Pulleys–*RA/SMC 1500 Series Rescue Pulley; RA/SMC Industrial Rescue Pulley; and Petzel KOOTENAY Knot–Passing Pulley; no date available.

Harken Catalog Cover Page and p. 70—"Airblocks"; and p. 71—"Snatch Blocks".

Cmi Moving & Handling Catalog Pages relating to "Service Line" Pulleys, 2 pages.

Wichard Catalog Page and page relating to "Stainless Steel Blocks".

PMI–Petzel Catalog Cover Page and page relating to Pulleys–RA/SMC 1500 Series Rescue Pulley; RA/SMC Industrial Rescue Pulley; and Petzl KOOTENAY Knot–Passing Pulley.

* cited by examiner

*Primary Examiner*—Katherine A. Matecki
(74) *Attorney, Agent, or Firm*—Lyon & Lyon LLP

(57) ABSTRACT

A high speed safety block assembly includes a first and second cheek plates with a sheave and axle installed between the cheek plates. The cheek plates each have a recessed area on their inner surfaces and have interlocking ears which increase the safety of the block assembly by preventing the block assembly from coming apart in the event of a screw failure. The sheave of the high speed safety block assembly includes a needle bearing which rolls on the bearing surface of the axle, permitting much higher loads and speeds when the high speed safety block assembly is used.

9 Claims, 3 Drawing Sheets

HIGH SPEED SAFETY BLOCK ASSEMBLY

BACKGROUND OF THE INVENTION

The field of the invention is block assemblies for suspending equipment and things with cables and the like.

Block assemblies have long been used to provide a mechanical advantage to reduce the pulling force required to support the load being suspended. For example, when a pair of block assemblies are used together, a 2:1 mechanical advantage is gained. When two pairs of block assemblies are used together, a 4:1 mechanical advantage is provided. Additional mechanical advantage is achieved by increasing the number of block assemblies used. Alternatively, a single block assembly can be used as a pulley to support a load without any mechanical advantage.

In the motion picture industry, especially in the stunt business, equipment and other items are frequently suspended from above with cables or ropes over block assemblies. Typically, the block assembly is high overhead and is not easily seen or inspected. Stunt persons and other actors are also frequently supported by cables using block assemblies. Thus, safety is a great concern, particularly with the reliability of the block assemblies.

When block assemblies are used in the stunt business, there are frequently high performance, reliability and safety demands placed on the equipment used. Thus, there is a need for a block assembly that is capable of supporting very high loads at high rates of speed, while maximizing the safety and reliability of the device.

SUMMARY OF THE INVENTION

To these ends, there is provided a high speed safety block assembly having first and second cheek plates with a sheave and axle located therebetween. The cheek plates each have a recessed area on their inner surfaces and have interlocking ears that increase the safety of the block assembly. The sheave of the high speed safety block assembly includes a needle bearing that rolls on the bearing surface of the axle. Other and further objects and advantages will appear hereinafter

BRIEF DESCRIPTION OF THE DRAWINGS

In the drawings, wherein similar reference characters denote similar elements throughout the several views.

DETAILED DESCRIPTION OF THE PREFERRED EMBODIMENTS

Figure 1:
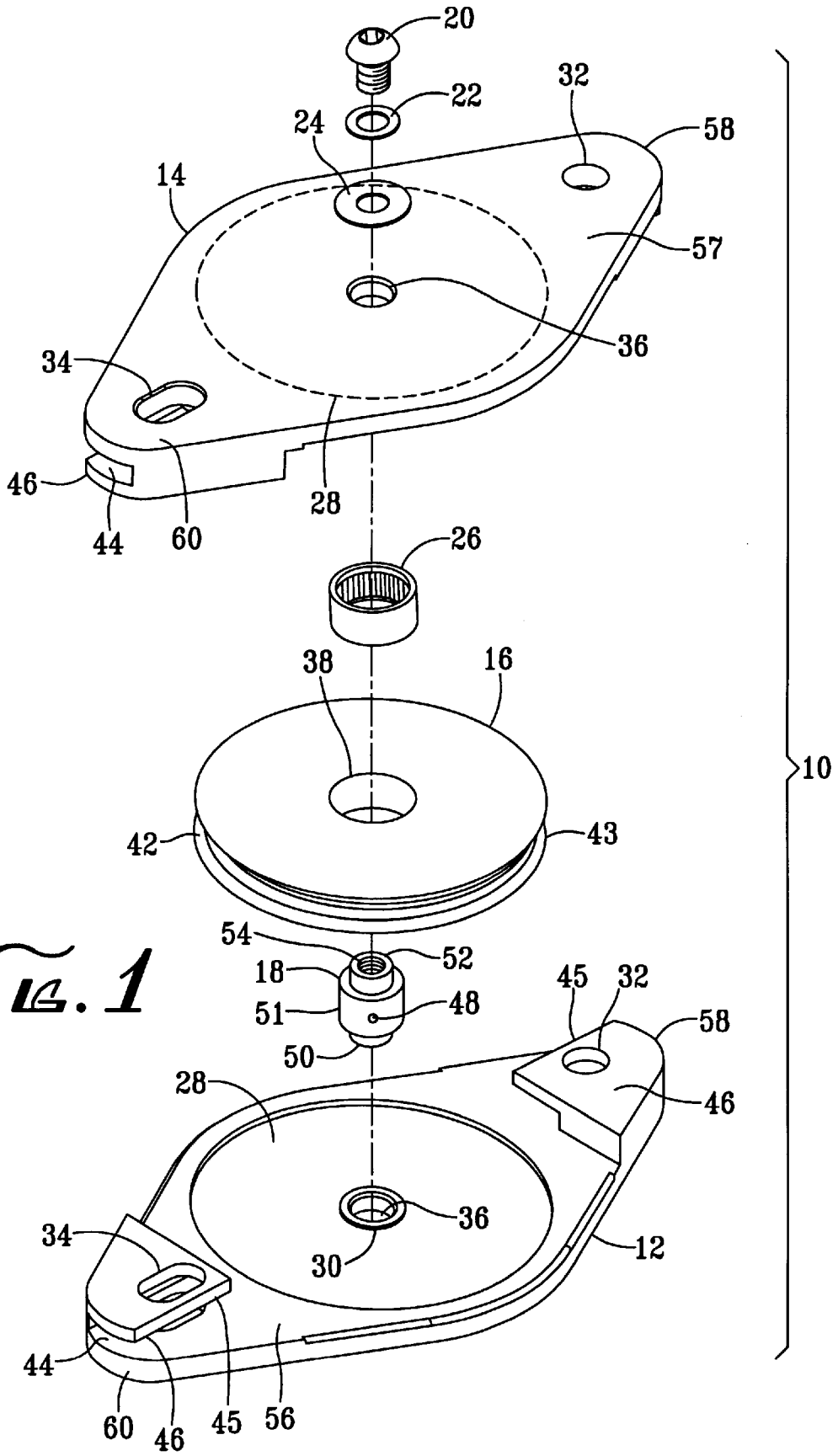
FIG. 1 is an exploded perspective view of a high speed safety block assembly.

Turning in detail to the drawings, FIG. 1 depicts a preferred embodiment of high speed safety block assembly 10. Block assembly 10 is comprised of a first cheek plate 12 and a second cheek plate 14. Held between cheek plates 12 and 14 is sheave 16 which is supported between cheek plates 12 and 14 by an axle 18. Block assembly 10 is held together with screw 20 and nylon washer 24 and steel washer 22.

Figure 4:
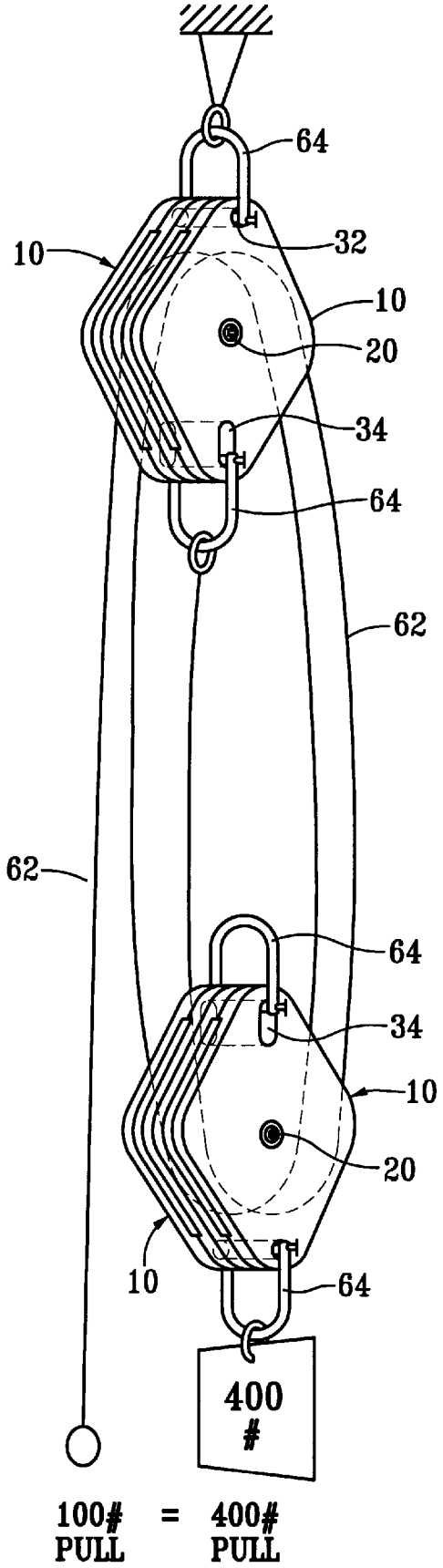
FIG. 4 depicts the combination of block assemblies to gain a mechanical advantage.

In a preferred embodiment, first cheek plate 12 and second cheek plate 14 are machined from aluminum and each have a top end 58 and a bottom end 60 and an inner surface 56 and an outer surface 57. Machined into inner surface 56 of cheek plates 12 and 14 is a recessed area 28. Recessed area 28 is slightly larger in diameter than sheave 16 which fits closely therein, and also has a through hole 36 centrally located. Recessed area 28 preferably also includes a raised shoulder 30 surrounding hole 36. Recessed area 28, into which sheave 16 fits, provides an additional measure of safety when block assembly 10 is in use as shown in FIG. 4. Recessed area 28 prevents cable 62 from slipping down onto axle 18 in the event cable 62 comes off of sheave 16.

Figure 2:
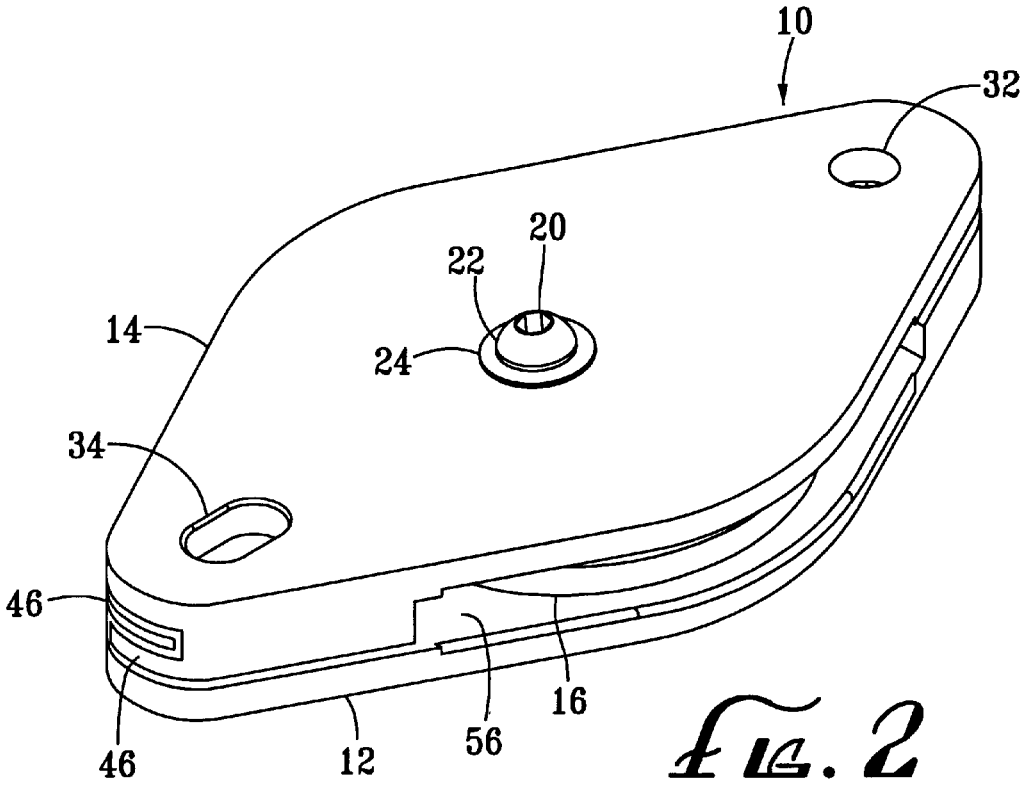
FIG. 2 is a perspective view of a high speed safety block assembly in a closed position.

Also machined into first cheek plate 12 and second cheek plate 14 are raised ear sections 46. Ear sections 46 are located at top end 58 and bottom end 60 of cheek plates 12 and 14. Ear sections 46 extend from inner surface 56 and define slots 44 between inner surface 56 and ear sections 46. Slot 44 is open at end 45 of each ear section 46. As shown in FIG. 1, ear sections 46 are arranged in opposite directions such that slot 44 and end 45 of ear section 46 at top end 58 of cheek plates 12 and 14 face the opposite direction of slot 44 and end 45 of ear section 46 at bottom end 60 of cheek plates 12 and 14. When block assembly 10 is assembled, as shown in FIG. 2, ear sections 46 on first cheek plate 12 fit into slots 44 on second cheek plate 14, and vice versa. The interlocking of ear sections 46 on cheek plates 12 and 14 provides and extra measure of safety by holding block assembly 10 together should screw 20 fail.

Cheek plates 12 and 14 also include a through hole 32 at top end 58 at ear section 46. Hole 32 serves as a point of attachment for block assembly 10, as shown in FIG. 4.

In a preferred embodiment of block assembly 10, cheek plates 12 and 14 are also provided with a slotted hole 34 through the plates at bottom end 60. Slotted hole 34 serves as a point of attachment when block assemblies 10 are combined to provide a mechanical advantage, as shown in FIG. 4. Slotted hole 34 advantageously allows for some tolerance when block assembly 10 is being rigged for use. Typically, a caribeener or shackle 64 is placed through slotted hole 34 which also provides an extra measure of safety in keeping block assembly 10 closed. In a preferred embodiment of block assembly 10, sheave 16 is a single circular piece of machined aluminum. Sheave 16 includes a groove 42 around the periphery of its rim 43. Groove 42 supports cable 62 when block assembly 10 is in use, as shown in FIG. 4. Sheave 16 has a through hole 38 located through the center of sheave 16. Sheave 16 also includes a needle bearing 26 installed into hole 38. In a preferred embodiment, needle bearing 26 is press fit into hole 38.

Axle 18 is preferably machined from hardened steel and includes a bearing surface 51, a first end 50, and a second end 52. Axle 18 preferably has a threaded hole 54 through the longitudinal axis of axle 18. The outside diameter of bearing surface 51 of axle 18 is matched to the inside diameter of needle bearing 26 such that when block assembly 10 is in use, needle bearing 26 of sheave 16 rolls on bearing surface 51 of axle 18. Axle 18 also advantageously includes a small transverse lubrication hole 48 through one side of bearing surface 51 to the center space defined by threaded hole 54. When block assembly 10 is in use, a lubricant is preferably put into threaded hole 54 whereby the lubricant will self lubricate roller bearing 26 through lubrication hole 48.

In a preferred embodiment, first end 50 of axle 18 has a larger outside diameter than second end 52. In this configuration, first end 50 of axle 18 is press fit into hole 36 on first cheek plate 12. With axle 18 press fit into hole 36 on first cheek plate 12, sheave 16, with needle bearing 26 already installed, can then be fitted onto axle 18 such that needle bearing 26 rolls on bearing surface 51 of axle 18. Second cheek plate 14 is then placed onto axle 18 with second end 52 of axle 18 fitting within hole 36 on second cheek plate 14. When block assembly 10 is in a closed position, such as shown in FIG. 2, block assembly 10 will hold together despite the absence of screw 20. To securely hold together block assembly 10, screw 20 is installed through hole 36 on second cheek plate 14 and into threaded hole 54 on second end 52 of axle 18. Preferably, nylon washer 24 and steel washer 22 are also used. Additionally, a second screw 20 (not shown) can be installed into threaded hole 54 at first end 50 of axle 18. This screw is not essential to hold block assembly 10 together, however, because first end 50 of axle 18 is press fit into hole 36 on first cheek plate 12.

FIG. 4 depicts the use of a combination of two pairs of block assemblies 10 to gain a 4:1 mechanical advantage. When block assemblies 10 are used side by side, as shown in FIG. 4, it is advantageous to arrange the block assemblies 10 such that first plate 12 of one block assembly 10 is set face to face with first cheek plate 12 of another block assembly 10. In this configuration, screw 20 is not installed into threaded hole 54 at first end 50 of axle 18 of either block assembly 10 so that the two block assemblies 10 may flush against each other, as shown in FIG. 4. Thus, when block assemblies 10 are combined or "ganged" together, no separate spacer (not shown) is required between the block assemblies 10.

Figure 3:
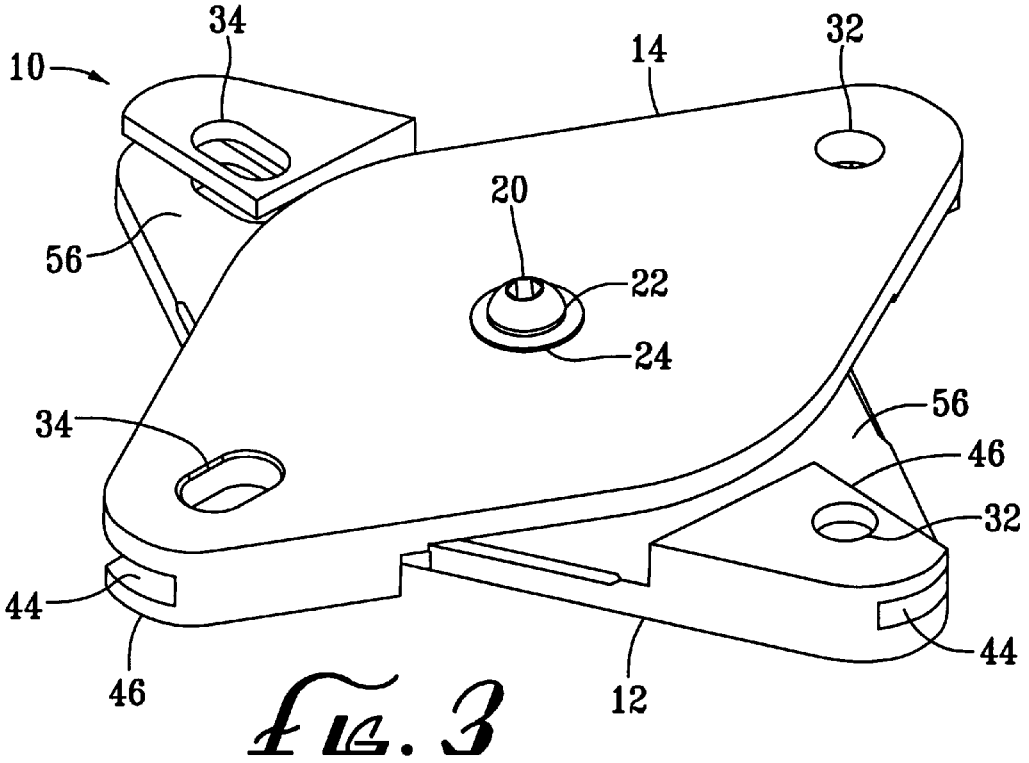
FIG. 3 is a perspective view of a high speed safety block assembly in an open position.

Once assembled, block assembly 10 can be opened as shown in FIG. 3. When cheek plates 12 and 14 are counter rotated, as shown in FIG. 3, access to sheave 16 is gained. In this fashion, a cable 62 or rope can be placed onto groove 42 of sheave 16 without having to disassemble block assembly 10. When rotated back to the closed position shown in FIGS. 2 and 4, block assembly 10 is ready for use.

When in use, block assembly 10 is capable of supporting greater loads and much higher rates of speed than prior devices. Prototypes of block assembly 10 have safely supported 5000 pound loads up to 2000 RPM (revolutions per minute) as well as 3000 pound loads up to 5000 RPM.

Lastly, while the features shown and described above exemplify the present invention, various modifications may be made without departing from the spirit and scope of the invention.

What is claimed is:

1. A high speed safety block assembly for use in stunt applications, comprising:

a first cheek plate and second cheek plate, the cheek plates each having a top end and a bottom end, the cheek plates also each having an outer surface and an inner surface, the inner surface of each cheek plate having a recessed area with an axle hole located centrally therein, the first and second cheek plates each also having a pair of raised ear sections at top and bottom ends, the raised ear sections forming a slot between the ear and the inner surface of the cheek plates, such that, the ear sections on the first cheek plate interlock with the ear sections on the second cheek plate, the cheek plates also each having a hole through the ear sections at the top end, the outer surface of each cheek plate including said ear sections having a substantially complete planar surface;

an axle having a bearing surface, the axle being positioned between the first and second cheek plates, and fitting within the axle holes on the first and second cheek plates; and a sheave positioned between the first and second cheek plates, the periphery of the sheave fitting closely within the recessed area of each cheek plate, the sheave having a central hole with a needle bearing fixed within the central hole, the needle bearing of the sheave fitting onto the bearing surface of the axle.

2. The high speed safety block assembly of claim 1, wherein the axle is press fit into the first cheek plate.

3. The high speed safety block assembly of claim 1, wherein the axle is hollow and includes a lubrication hole through the bearing surface of the axle.

4. The high speed safety block assembly of claim 1, wherein the needle bearing is press fit into the sheave.

5. The high speed safety block assembly of claim 1, wherein the first and second cheek plates have a hole through the ear sections at the bottom end.

6. The high speed safety block assembly of claim 5, wherein the hole at the bottom end of the first and second cheek plates is elongated.

7. A high speed safety block assembly for use in stunt applications, comprising:

a first cheek plate and second cheek plate, the cheek plates each having a top end and a bottom end, the cheek plates also each having an outer surface and an inner surface, the inner surface of each cheek plate having a recessed area with an axle hole located centrally therein, the first and second cheek plates each also having a pair of raised ear sections at top and bottom ends, the raised ear sections forming a slot between the ear and inner surface of the cheek plates, such that, the ear sections on the first cheek plate interlock with the ear sections on the second cheek plate, the cheek plates also each having a hole through the ear sections at the top and bottom ends, the outer surface of each cheek plate including said ear sections having a substantially complete planar surface;

a hollow axle with a bearing surface and having a lubrication hole through the bearing surface, the axle being positioned between the first and second cheek plates, and press fit within the axle holes on the first cheek plate; and a sheave positioned between the first and second cheek plates, the periphery of the sheaving fitting closely within the recessed area of each cheek plate, the sheave having a central hole with a needle bearing press fit within the central hole, the needle bearing of the sheave fitting onto the bearing surface of the axle.

8. A multiple high speed safety block assembly, comprising:

at least two high speed safety block assemblies, the safety block assemblies each comprising a first cheek plate and second cheek plate, the cheek plates each having a tog end and a bottom end, the cheek plates also each having an outer surface and an inner surface, the inner surface of each cheek plate having a recessed area with an axle hole located centrally therein, the first and second cheek plates each also having a pair of raised ear sections at top and bottom ends, the raised ear sections forming a slot between the ear and the inner surface of the cheek plates, such that, the ear sections on the first cheek plate interlock with the ear sections on the second cheek plate, the cheek glates also each having a hole through the ear sections at the top end, the outer surface of each cheek plate including said ear sections having a substantially complete planar surface;

an axle having a bearing surface, the axle being positioned between the first and second cheek plates, and fitting within the axle holes on the first and second cheek plates; and a sheave Positioned between the first and second cheek plates, the periphery of the sheave fitting closely within the recessed area of each cheek plate, the sheave having a central hole with a needle bearing fixed within the central hole, the needle bearing of the sheave fitting onto the bearing surface of the axle;

the at least two block assemblies coupled together such that the safety block assemblies rest against each other face to face on the outer surface of the cheek plates, and a bolt positioned through the hollow axles of the safety block assemblies and securely coupling the safety block assemblies to each other.

9. A high speed safety block assembly for use in stunt applications, comprising:

a first cheek plate and second cheek plate, the cheek plates each having a top end and a bottom end, the cheek plates also each having an outer surface and an inner surface, the inner surface of each cheek plate having a recessed area with an axle hole located centrally therein, the first and second cheek plates each also having a pair of raised ear sections at top and bottom ends, the raised ear sections forming a slot between the ear and the inner surface of the cheek plates, such that, the ear section on the first cheek plate interlock with the ear section on the second cheek plate, the cheek plates also each having a hole through the ear sections at the top end;

an axle having a bearing surface, the axle being positioned between the first and second cheek plates, and fitting within the axle holes on the first and second cheek plates; and a sheave positioned between the first and second cheek plates, the periphery of the sheave fitting closely within the recessed area of each cheek plate, the sheave having a central hole with a needle bearing fixed within the central hole, the needle bearing of the sheave fitting onto the bearing surface of the axle.

* * * * *

UNITED STATES PATENT AND TRADEMARK OFFICE

CERTIFICATE OF CORRECTION

PATENT NO. : 6,244,570 B1
DATED : June 12, 2001
INVENTOR(S) : Jeff Habberstad

It is certified that error appears in the above-identified patent and that said Letters Patent is hereby corrected as shown below:

Column 4,
Line 51, change “tog” to read -- top --.
Line 60, change “glates” to read -- plates --.

Column 5,
Line 1, change “Positioned” to read -- positioned --.

Signed and Sealed this

Tenth Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,244,570 B1
DATED : June 12, 2001
INVENTOR(S) : Jeff Habberstad

It is certified that error appears in the above-identified patent and that said Letters Patent is hereby corrected as shown below:

Column 4,
Line 41, change “sheaving” to read -- sheave --.

Signed and Sealed this

Third Day of December, 2002

JAMES E. ROGAN
*Director of the United States Patent and Trademark Office*